US006629605B2

(12) United States Patent
Frohn

(10) Patent No.: US 6,629,605 B2
(45) Date of Patent: Oct. 7, 2003

(54) PLASTIC CONTAINER WITH RELEASABLE, ELASTICALLY FIXED STACKING CAP

(75) Inventor: Walter Frohn, Munich (DE)

(73) Assignee: Dr. Ing. Walter Frohn, Munich (DE)

( * ) Notice: Subject to any disclaimer, the term of this patent is extended or adjusted under 35 U.S.C. 154(b) by 4 days.

(21) Appl. No.: 09/797,943

(22) Filed: Mar. 5, 2001

(65) Prior Publication Data

US 2002/0023856 A1 Feb. 28, 2002

(30) Foreign Application Priority Data

Jun. 26, 2000 (DE) ..... 200 11 229

(51) Int. Cl.[7] ..... B65D 45/00
(52) U.S. Cl. ..... 206/501; 220/508; 220/821
(58) Field of Search ..... 206/501, 503, 206/821; 220/23.6

(56) References Cited

U.S. PATENT DOCUMENTS

| | | | | | |
|---|---|---|---|---|---|
| 317,374 | A | * | 5/1885 | Goldsmith | 29/3 |
| 3,180,537 | A | * | 4/1965 | Collins | 222/480 |
| 3,885,672 | A | * | 5/1975 | Westenrieder | 206/503 |
| 4,125,683 | A | * | 11/1978 | Beckford et al. | 429/121 |
| 5,915,557 | A | * | 6/1999 | Levine | 206/509 |
| 6,142,330 | A | * | 11/2000 | Sacks | 220/23.6 |

* cited by examiner

*Primary Examiner*—Joseph M. Moy
(74) *Attorney, Agent, or Firm*—Burns, Doane, Swecker & Mathis, L.L.P.

(57) ABSTRACT

A plastic container includes an integral pour spout and an integral carrying handle. A separate stacking cap is attachable to the top of the container to facilitate the stacking of an additional container thereon. The stacking cap is removably lockable to the container by a tooth-and-recess connection, wherein the tooth is adapted to spring elastically into a recess.

15 Claims, 5 Drawing Sheets

PLASTIC CONTAINER WITH RELEASABLE, ELASTICALLY FIXED STACKING CAP

SPECIFICATION

This application claims priority under 35 U.S.C. §§119 and/or 365 to Patent Application Serial No. 200 11 229.5 filed in Germany on Jun. 26, 2000, the entire content of which is hereby incorporated by reference.

BACKGROUND OF THE INVENTION

Conventional plastic stacking containers have a horseshoe-shaped stacking surface blown from the top surface and making it possible to stack a further container above this one.

If very high requirements are demanded for the stability in the stack of plastic stacking containers, particularly for liquid hazardous goods, it is recommended to configure the blown containers with a vaulted top surface and to set on this an additional, separate plastic injection molded part as the stacking cap, preferably with a horseshoe shape.

The configuration of such a stacking cap container confers the advantage that the plastic required for blowing out the stacking surface in conventional stacking containers can be saved. Furthermore, the barrel-shaped constitution of the upper surface increases the stack crushing pressure stability of the container and prevents buckling under heavy vertical loads.

Furthermore, the embodiment of a stacking container with stacking cap ensures a complete emptying of residue from the container, even when this is placed upside down.

A heretofore unsolved problem was the construction of a cost-saving, but at the same time also secure and releasable, elastic locking between the container's top surface and the stacking cap.

The mounting of a conventional stacking cap takes place as a rule by means of complicated, labor-intensive bolt connections to the upper surface of the container.

In other embodiments, which correspond to the state of the art, the fixing of the stacking cap on the container's top surface is effected in that the stacking cap supportively engages around the transitions from the upper surface into the vertical walls of the container, and centering occurs by means of a recess on the stacking cap which engages around the container mouth. In the latter case, a sideways slipping of the stacking cap under high stacking load or during transportation of a loaded pallet is not excluded.

The invention has as its object to provide a plastic container having a filling and pouring neck and a carrying handle, with a flat or vaulted top surface, with a stacking cap of thermoplastic plastic releasably mounted on the container's top surface, the stacking cap being mounted, secure against displacement, on the container's top surface. Furthermore, the mounting of the stacking cap on the container's top surface is to take place cost-effectively and fully automatically.

SUMMARY OF THE INVENTION

This object is attained by a plastic container with a filling and pouring neck and a carrying handle, with a flat or vaulted upper surface, with a stacking cap of thermoplastic plastic releasably mounted on the upper surface of the container, in which the elastic connection between the container's top surface and the stacking cap takes place by locking of the stacking cap to the container by means of teeth which spring into recesses.

In a preferred basic embodiment, the locking takes place such that teeth which are installed, longitudinally or transversely of the symmetry axis of the container, on the vertical webs, preferably the handle supports, located on the container's top surface, lock under prestress into corresponding recesses of the stacking cap upon vertical mounting pressure of the same.

In another preferred basic embodiment of the plastic container according to the invention, the locking of the stacking cap takes place such that teeth installed on the stacking cap in the direction of its symmetry axis or transversely thereof lock into corresponding recesses on vertical projections situated on the container's top surface upon vertically setting the stacking cap onto the container.

BRIEF DESCRIPTION OF THE DRAWINGS

The above and further features of the invention are explained hereinbelow with the aid of preferred embodiments of the stacking container according to the invention, with reference to the Figures of the drawings.

DETAILED DESCRIPTION OF PREFERRED EMBODIMENTS

Figure 1:
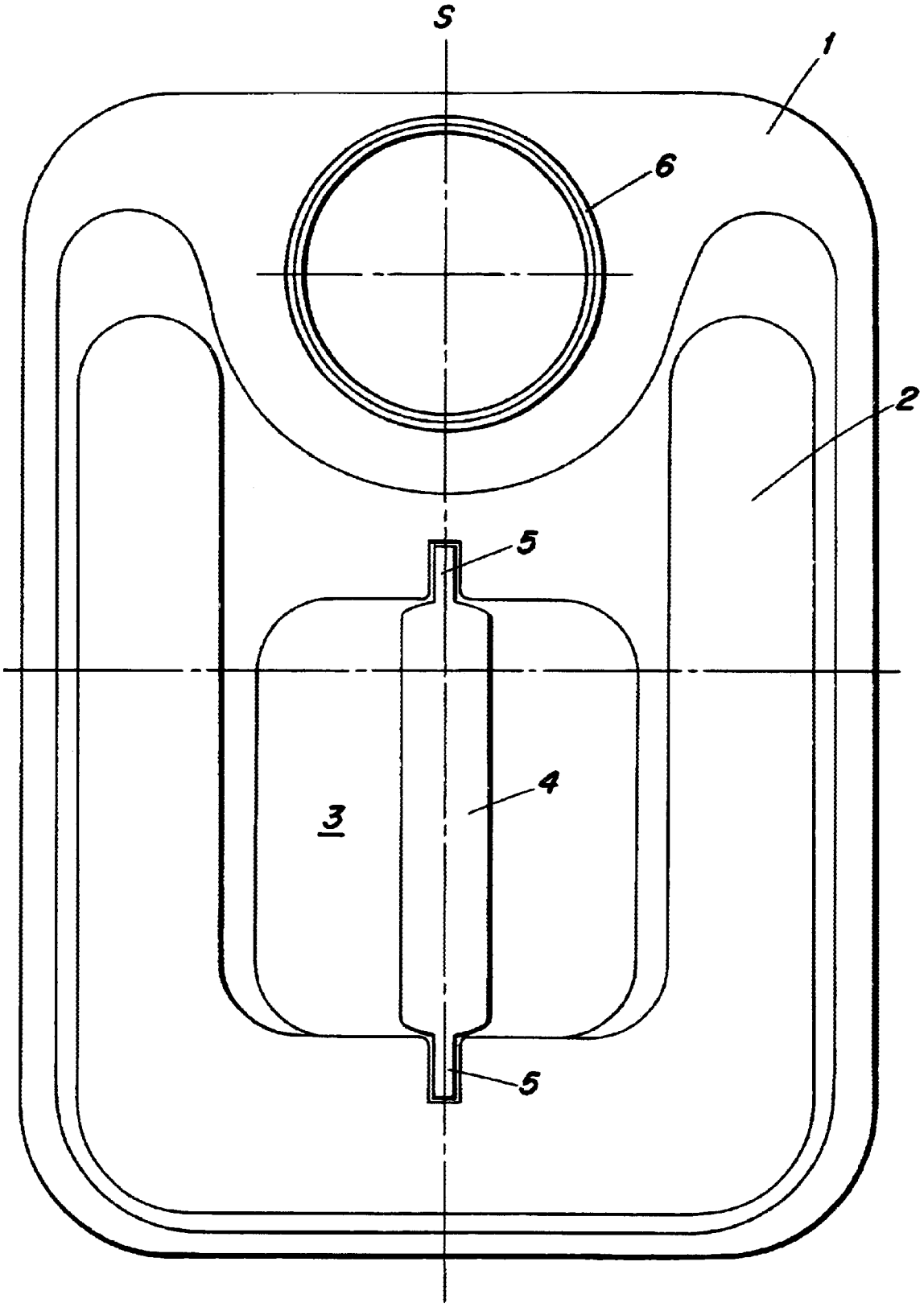
FIG. 1 shows a plan view of a plastic stacking container with a stacking cap set on it.

The stacking container 1 shown has a carrying handle 4 and a filing and pouring neck 6 with a screw cap, the stacking surface being formed by a separate stacking cap 2, made of plastic by an injection molding process, set thereon.

The supports 5 of the carrying handle 4 are liquid-tightly squeezed off from the entry into the upper surface 3, so that the container empties without residue, even in an upside-down position.

The fastening of the stacking cap 2 to the vaulted or planar container's top surface 3 takes place by locking.

Figure 2:
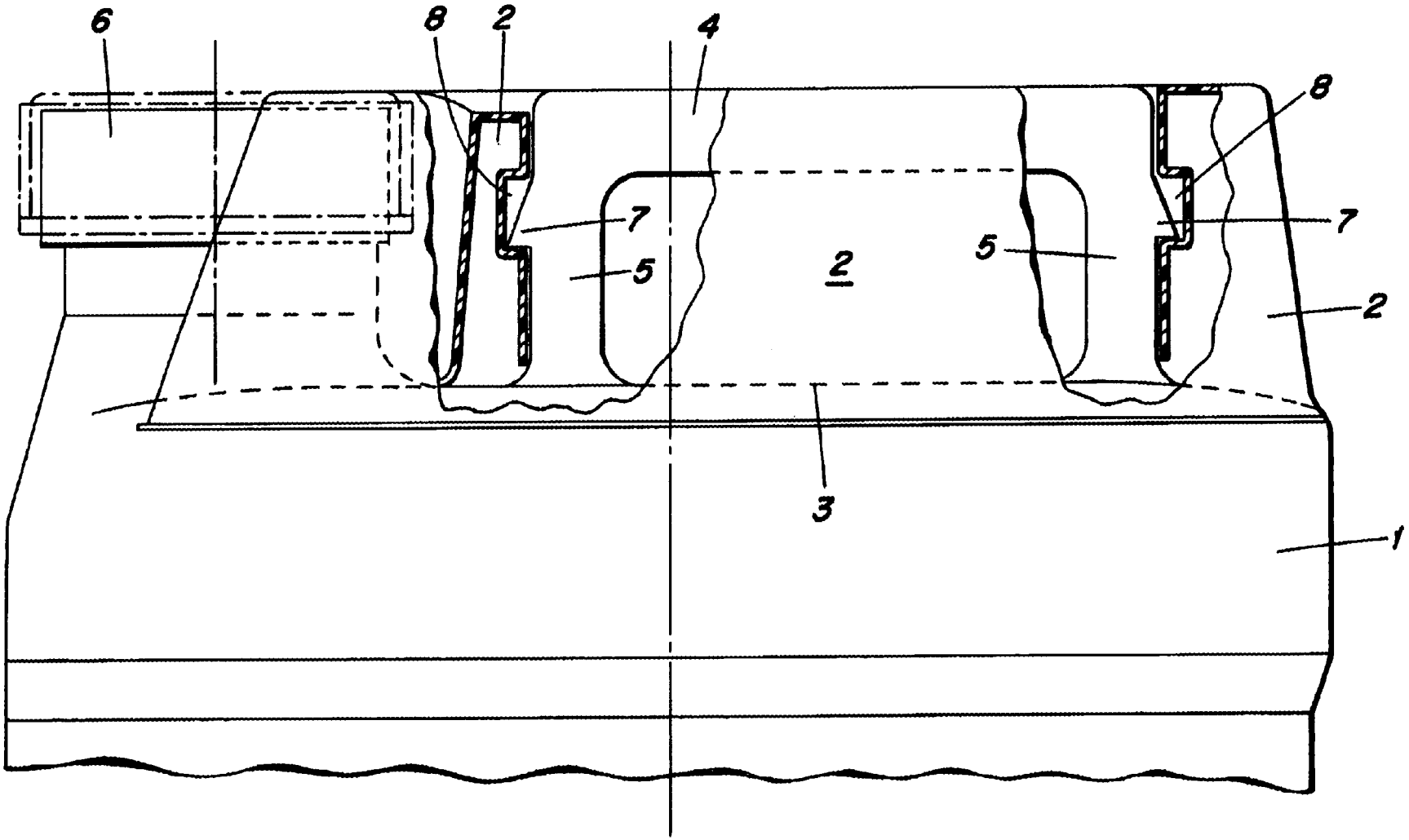
FIG. 2 shows a side view of a preferred embodiment of the plastic container with stacking cap, according to the invention, in which the locking takes place by means of teeth arranged along the symmetry axis on the handle support of the container into corresponding recesses of the stacking cap.
Figure 3:
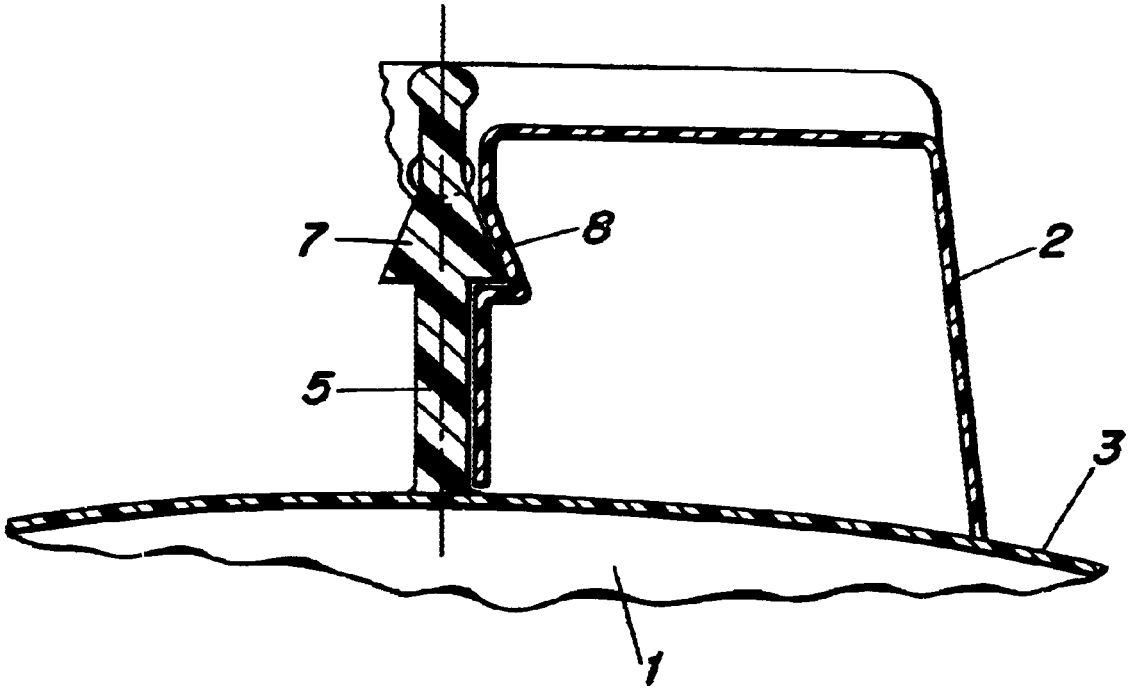
FIG. 3 shows a rearward view of a preferred embodiment of the plastic container with stacking cap, according to the invention, in which the locking takes place by means of teeth arranged transversely of the symmetry axis of the container on the handle support into corresponding recesses of the stacking cap.
Figure 5:
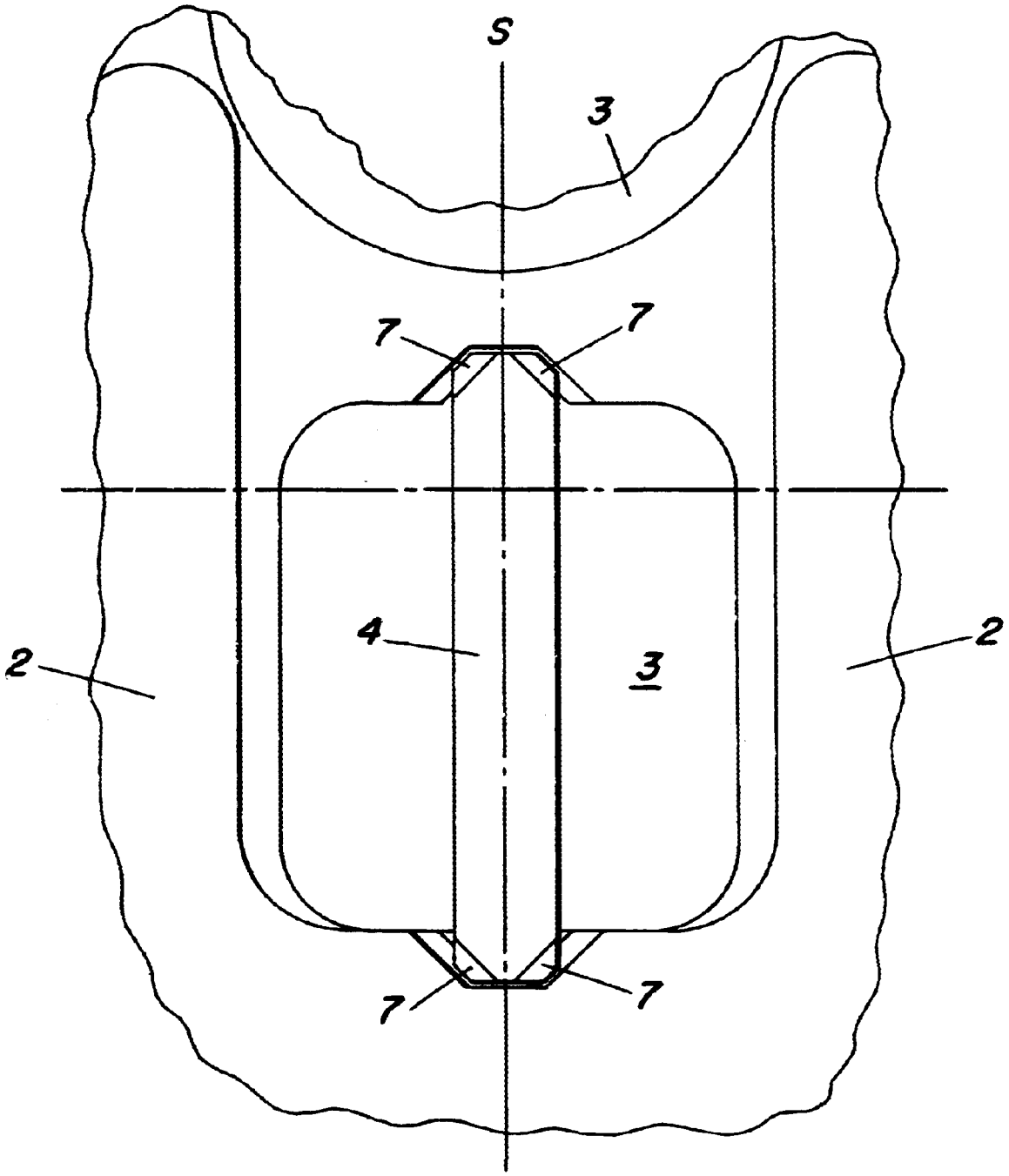
FIG. 5 shows a plan view of the container according to the invention, wherein the locking of the stacking cap onto the container's top surface takes place by means of teeth installed on the handle support at a 45° angle to the symmetry axis of the container into corresponding recesses of the stacking cap.

In the embodiment examples of FIGS. 2, 3 and 5, the locking takes place by means of teeth 7 which are installed on vertical webs 5, preferably the supports of the carrying handle 5, installed on the upper surface. These teeth 7 spring into corresponding recesses 8 of the stacking cap 2 upon vertically pressing the stacking cap onto the upper surface. The teeth 7 can be alternatively installed in the symmetry axis S of the container, transversely of it, or respectively symmetrically at an angle situated therebetween with respect to it.

Figure 4:
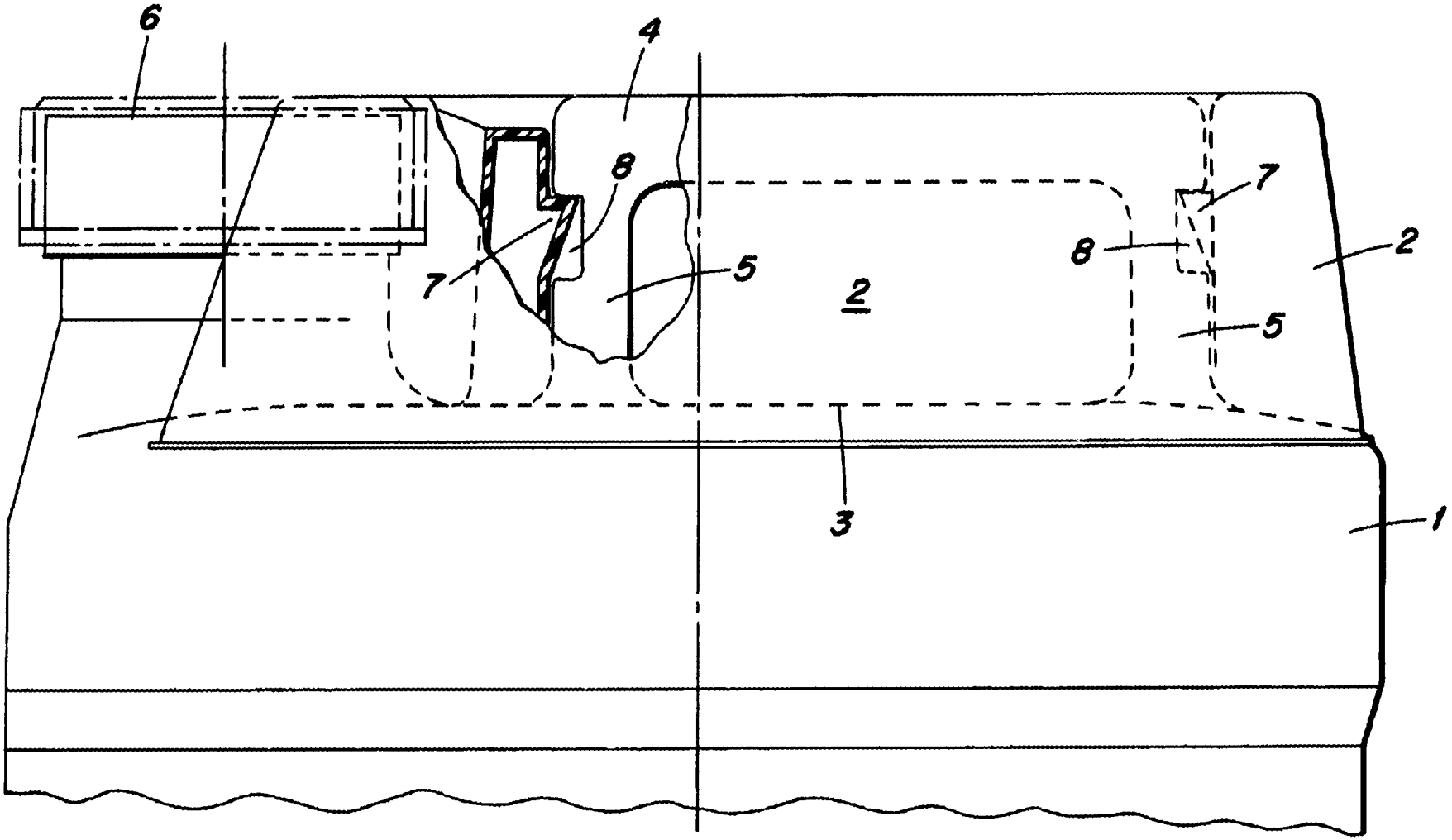
FIG. 4 shows a side view of the container according to the invention, wherein the locking takes place by means of teeth installed on the stacking cap in its symmetry axis into corresponding recesses of the handle support of the container.

In the embodiment example of FIG. 4, the locking takes place by means of teeth 7 installed on the stacking cap 2 and locking into recesses 8 of the vertical webs 5 of the container's top surface 3, preferably the carrying handle supports 5.

A simple mounting of the stacking cap 2 by means of automatic vertical pressing-on of the same is ensured by this form of fixing of the stacking cap 2 to the container upper surface 3 by locking. Furthermore, an exact positioning and force fit of the stacking cap 2 on the container's top surface 3 is attained, on account of a displacement of the stacking cap on the container's top surface being excluded because of the perfect centering by the locking fastening 7, 8.

List of Reference Numbers

1 plastic container
2 stacking cup
3 container's top surface
4 carrying handle
5 support of the carrying handle/vertical web
6 filling and pouring neck
7 teeth
8 recesses

What is claimed is:

1. Plastic container comprising a filling and pouring neck and a carrying handle, a top surface of the container being flat or vaulted, a stacking cap of thermoplastic mounted on the container's top surface, wherein an elastic connection between the container's top surface and the stacking cap is defined by an elastic locking of the stacking cap to the container by means of teeth springing into respective recesses.

2. Plastic container with a stacking cap according to claim 1 wherein the stacking cap is held immovable relative to the container while the teeth are in the respective recesses.

3. Plastic container with a stacking cap according to claim 1 wherein the teeth are arranged on the container, and the recesses are formed in the stacking cap.

4. Plastic container with a stacking cap according to claim 3 wherein the teeth are configured to enter the recesses in response to relative vertical movement between the container and the stacking cap.

5. Plastic container with a stacking cap according to claim 3 wherein the teeth are arranged on vertical supports located on the container's top surface.

6. Plastic container with a stacking ap according to claim 5 wherein the vertical supports form part of the carrying handle.

7. Plastic container with a stacking cap according to claim 5 wherein the vertical supports lie along a symmetry axis of the container passing through the pour spout.

8. Plastic container with a stacking cap according to claim 7 wherein the teeth lie along the symmetry axis.

9. Plastic container with a stacking cap according to claim 7 wherein the teeth project transversely with respect to the symmetry axis.

10. Plastic container with a stacking cap according to claim 1 wherein the teeth are arranged on the stacking cap, and the recesses are formed in the container.

11. Plastic container with a stacking cap according to claim 10 wherein the teeth are configured to enter the recesses in response to relative vertical movement between the container and the stacking cap.

12. Plastic container with a stacking cap according to claim 10 wherein the recesses are formed in vertical supports located on the container's top surface.

13. Plastic container with a stacking cap according to claim 12 wherein the vertical supports form part of the carrying handle.

14. Plastic container with a stacking cap according to claim 13 wherein the recesses lie along a symmetry axis of the container passing through the pour spout.

15. Plastic container with a stacking cap according to claim 1 wherein the stacking cap is on the container's top surface.

* * * * *